United States Patent [19]

Glaesener

[11] 4,290,585

[45] Sep. 22, 1981

[54] VEHICLE-STOPPING DEVICE FOR SAFETY BARRIERS

[75] Inventor: Ernest Glaesener, Luxembourg, Luxembourg

[73] Assignee: Arbed S.A., Luxembourg, Luxembourg

[21] Appl. No.: 29,478

[22] Filed: Apr. 12, 1979

[30] Foreign Application Priority Data

Apr. 15, 1978 [DE] Fed. Rep. of Germany ..... 2816487

[51] Int. Cl.[3] ..... E61F 15/00

[52] U.S. Cl. ..... 256/13.1; 404/6

[58] Field of Search ..... 404/6, 10, 9; 256/1, 256/13.1

[56] References Cited

U.S. PATENT DOCUMENTS

| | | | |
|---|---|---|---|
| 2,088,087 | 7/1937 | Hudson | 256/1 |
| 3,141,655 | 7/1964 | Platt | 256/1 X |
| 3,307,833 | 3/1967 | Muller | 404/6 X |
| 3,693,940 | 9/1972 | Kendall | 256/13.1 |
| 3,717,326 | 2/1973 | Leach | 404/6 X |
| 3,845,936 | 11/1974 | Boedecker | 256/13.1 X |
| 3,856,268 | 12/1974 | Fitch | 256/13.1 |
| 3,881,697 | 5/1975 | Glaesener | 256/13.1 |
| 3,963,218 | 6/1976 | Glaesener | 256/13.1 |

*Primary Examiner*—Nile C. Byers, Jr.
*Attorney, Agent, or Firm*—Karl F. Ross

[57] ABSTRACT

A barrier for highway traffic of the type designed to bring a vehicle to standstill and avoid contact with a roadside hazard, e.g. a post, abutment or pylon, comprises an array of upstanding posts adapted to cushion the impact and increasing in number and height in the direction of travel of the vehicle toward the barrier to impose increasing resistance to traveling. The posts each comprise an upper and a lower section or portion in the form of tubes of which the lower tube is set into the ground while the upper tube is composed of thin sheet metal lined with or filled by a cushioning material such as a foamed synthetic resin. The two tubes or sections of each post are interconnected by a cast iron link which is designed to shear at ground level in part dissipating the kinetic energy of the vehicle. The upper tubes of the array are interconnected by chains.

7 Claims, 4 Drawing Figures

VEHICLE-STOPPING DEVICE FOR SAFETY BARRIERS

FIELD OF THE INVENTION

The present invention relates to a safety barrier for highways, roads, expressways, streets and the like designed to prevent impact of the vehicle against a road hazard, such as post, pylon or abutment, by gradually dissipating the kinetic energy of the vehicle and cushioning the deceleration thereof so as to bring the vehicle to standstill before it impacts against the barrier.

BACKGROUND OF THE INVENTION

A wide variety of roadside barriers have been developed in recent years out of concern for the motorist and for the structures normally provided along a vehicle path such as an expressway, highway, road or street.

The road hazard may be any of a variety of structures of sufficient mass or rapidity to endanger the motorist traveling at high speed should, because of misadventure, operator failure or impact with another vehicle, a vehicle be directed or misdirected toward the hazard. The latter may be post for the traffic or roadway lighting or signs, a pylon, post or other pedestal supporting an overpass or utility lines, or simply an abutment which may be required in the design of the road.

Generally it has been the practice, especially in recent years, to provide upstream of the hazard in the direction of vehicle travel, a safety barrier of some sort to cushion any untoward travel toward the abutment.

For example, yieldable fences may be provided to direct a vehicle back into the traveling lane or along a shoulder flanking the hazard. Such systems have had the disadvantage that they may be torn away should they receive an impact at an improper angle or excessively high speed or from an especially heavy vehicle; they also may result in a deflection of the vehicle in an uncontrolled manner into the path of moving traffic creating danger not only to the occupants of the misdirected vehicle but also to occupants of other vehicles in the traffic lane.

Hence efforts to improve vehicular safety have concentrated upon devices designed to cushion the impact without deflecting the vehicle. Typical of such devices are flexible-wall structures containing yieldable materials such as water or sand, which take up a portion of the impact energy before they are dispersed or broken. Such devices have been found to be disadvantageous in many cases because they do not provide a sufficiently gradual deceleration of the vehicle to prevent damage thereto and injury to its occupants.

Considerably more satisfactory devices have been developed as described, for example, in my U.S. Pat. No. 3,881,697, which refers, in turn, to earlier systems found in U.S. Pat. Nos. 3,704,861 and 3,784,167, which may also be consulted in this connection.

Reference may be had also to U.S. Pat. No. 2,088,087, No. 2,134,624, No. 3,503,600, No. 3,606,248, No. 3,643,924, No. 3,674,115, No. 3,680,662, and No. 3,693,840 which were cited in the file of Ser. No. 407,998, the application upon which U.S. Pat. No. 3,881,697 issued.

For the details of the foamed synthetic-resin material, thin walled tubular structure, positioning of the posts and the like, my U.S. Pat. No. 3,881,697 may be consulted.

As noted, the system of U.S. Pat. No. 3,881,697 has the advantage that it provides a plurality of deflectible posts of increasing density and height in the direction of traveling toward the hazard or barrier and which gradually brings the vehicle to a standstill without impact against the hazard primarily by frictional engagement with the vehicle body and with minimal damage to the vehicle.

This is important because it also protects the occupants of the vehicle during the deceleration thereof.

In the system of U.S. Pat. No. 3,881,697, this is achieved by providing an array of upright but deflectible posts which extend longitudinally in the direction of travel toward the hazard and in the area ahead of the obstacle. The elongated bodies or posts are disturbed upon impact and are bent over in the direction of travel, thereby absorbing kinetic energy by deformation and by frictionally rubbing against the vehicle body.

It is important in that system that the absorption of kinetic energy be carried out over a fairly extended distance, corresponding to the length of the array, with damage to the vehicle being prevented because the vehicle tends to override the bands of the posts.

In the design of all such barriers, however, there is usually a compromise between the need to bring the vehicle to a complete stop before it reaches the hazard and the desire to carry out the deceleration as gradually as possible so that neither the vehicle nor its occupants will suffer injury because of an excessively rapid deceleration.

Test have shown that the barrier described in U.S. Pat. No. 3,881,697 can bring most vehicles traveling at speeds up to 100 km/hr, to a complete stop without noticeable damage to the vehicle, injury to the occupants, or impact with the road hazard.

However, although the latter system affords a significant advance from a safety point of view it has the disadvantage that many of the upright bodies are permanently deformed (i.e. bent) by the impact and as a result of the energy absorption. In the earlier system straightening of these bodies was time-consuming and frequently unsuccessful, while replacement of the device was expensive and authorities responsible for their installation have had to reckon with considerable expenditures in this connection.

The high cost is a result, in part, of the fact that the uptight bodies generally comprise an outer tube drawn or rolled from steel sheet and a synthetic foam filling and/or lining which is not expensive.

OBJECTS OF THE INVENTION

It is the principal object of the present invention, to provide an improved upright construction for use in a safety barrier of the type described in U.S. Pat. No. 3,881,697, but which is free from the disadvantages thereof, namely, high replacement cost.

Another object of the invention is to provide an improved upright or post for use in safety barriers which has improved energy absorption but which, subsequent to impact, can be restored readily and relatively inexpensively to an effective state.

Yet another object of the invention is to provide an improved safety barrier which is amenable to restoration to an operative state after impact in an expensive and efficient manner and which, nevertheless, affords the gradual stopping of a misdirected motor vehicle with the qualities of the system described in U.S. Pat. No. 3,881,697.

SUMMARY OF THE INVENTION

These objects and others which will become apparent hereinafter are attained, in accordance with the present invention, by providing a barrier of the configuration described and illustrated in U.S. Pat. No. 3,881,697 but wherein each post, column or upright is formed with a shear member close to the ground and at which upon impact, an upper portion of the post can be separated from a lower portion by rupture of this replaceable shear member so that, subsequent to the removal of the vehicle, the broken shear member parts can be extracted, a new shear member inserted, and the upper and lower portion repositioned for effective use.

Thus the present invention provides a safety barrier ahead of a road hazard in the vehicle-travel direction which is elongated and formed by a multiplicity of spaced apart uprights or posts (i.e. upright bodies) which are sheared off by impact for the slowing of a misdirected vehicle and absorbing its kinetic energy.

Thus, when the upper portions of the upright bodies are formed as described in the latter patent, i.e. have sheet metal casings which are lined and/or filled with foamed synthetic-resin material, a portion of the kinetic energy absorption is a result of the compression of the cushioning body, another portion is a result of frictional contact of the vehicle with the surface of these bodies, and the main portion of the energy absorbed is converted to shear force.

The bodies of the device may be disposed in successive rows of progressively increasing height, in the direction of the hazard, the density (number of bodies per unit area) increasing in the direction of the hazard so as to have a maximum directly ahead of or around the hazard.

A vehicle deviating from the normal travel path thus encounters the front row of upright bodies or slides across them applying transverse force which, until a predetermined maximum is achieved, results in frictional and compression dissipation of kinetic energy.

Once this maximum is reached, the body is sheared off at ground level and if this is insufficient to halt the vehicle, it engages the next row of bodies and so on.

According to a feature of the invention, each of the bodies comprises three main parts, namely, an upper tube member extending above ground level, a lower tube member set into the ground for anchoring the upright, and a shear member in the form of a rigid link, preferably of cast iron, extending into both of these members and forming a weak spot connecting same. Since the elongated link can be embedded above ground level in the upper tube member and its filling, and the lower portion of the link is wholly received in the lower tube member, the weak spot or breaking point will lie at the junction between the two members.

The upper tube which may be filled with synthetic resin foam or lined internally and/or externally therewith, is advantageously composed of steel sheet of a thickness of 0.5 to 2 mm and which, for anticorrosion protection, may be galvanized by hot dipping.

The synthetic resin foam should have a density which is less than 150 kp/m$^3$. The synthetic resin foam material not only provides a cushioning effect but also minimizes distortion of the sheet steel tube and assists in dissipating energy by compression.

The lower tube is also composed of steel, in a preferred embodiment of the invention, and may be set directly into the ground provided that the ground has sufficient firmness to resist displacement of the lower portion of the rigid link. When the ground does not have sufficient firmness, the lower tube may be set in concrete formed in situ or in a concrete slab from which the elongated bodies extend upwardly.

According to another feature of the invention, the link which plays the major portion in absorbing the kinetic energy of the vehicle to be slowed down, is vertically elongated and has an upper end removably reaching into the upper tube and snugly fitted therein and a lower end which is removably received in the lower tube and is snugly held therein. Preferably a collar is provided between these ends to lie at ground level and to rest upon the edges of the lower tube to constitute the weak spot.

It has been found to be advantageous, moreover, to make the lower end of the shear link of somewhat larger diameter than the upper end thereof, the link being thus of stepped cylindrical or annular shape and ensuring that the shear or break point will be adjacent the collar or shoulder. This construction also ensures a firm setting of the link within the lower tube.

According to an important feature of the invention, the upper portion of each elongated body is connected with the upper portions of the remaining bodies by a network of flexible members, especially chains or ropes, which prevent sheared bodies from piling up in front of the vehicle or flying off, causing danger to other vehicles or passersby.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
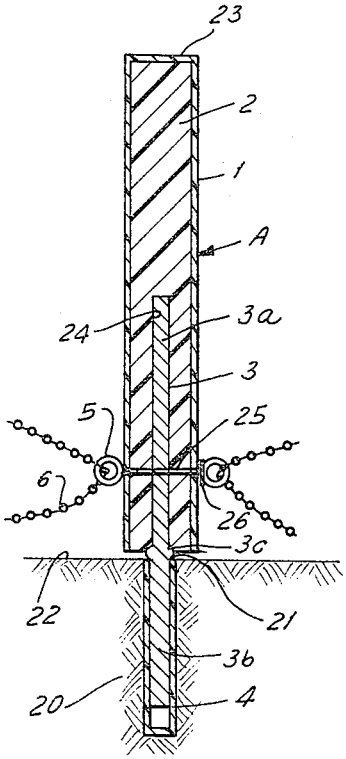
FIG. 1 is a vertical cross section through an upright body according to the present invention for use in a roadside safety apparatus of the type described in U.S. Pat. No. 3,881,697.

In FIG. 1 I have shown an upright body or post for use in a system such as that of U.S. Pat. No. 3,881,697 and which comprises a lower sheet metal tube 4 which is sunk in the ground 20 so that its upper edge 21 is flush with the ground surface 22. The upper tube 1 is closed at its end 23 but downwardly open and is filled with the foamed synthetic resin mass 2.

In this case, the lower end of the upper tube may just touch the ground 22.

Both tubes are held together by a link 3 whose cylindrical upper end 3*a* reaches removably into a hollow space 24 of the foam mass 2 while the lower end 3*b* is cylindrical and can be received removably (with a loose or snug fit) in the lower tube 4.

Between the upper and lower portions 3*a* and 3*b* of the link, there is formed an outwardly extending circular flange or collar 3*c* which rests upon the edges 21 of the lower tube and defines the weak spot of the link which is composed of cast iron.

In this best-mode embodiment of the invention, all of the upright bodies are interconnected by chains 6 (see FIGS. 3 and 4) which pass through eyes 5 of eyebolts 25 traversing the upper members and threadedly engaged by nuts 26 also formed with such eyes 5.

When a vehicle (e.g. the vehicle V in FIG. 3) encounters a post 1 in the direction of the arrow A (FIG. 1), there is a frictional engagement between the outer tube wall and the vehicle, followed by a compression of the tube and hence of the foamed filling. When the predetermined maximum force is exceeded, the link breaks immediately at collar 3*c* and the chains 6 prevent free flight of the broken upright body.

To replace the post, the two parts 3*a* and 3*b* of the broken link are withdrawn from the space 24 and the lower tube 4, respectively, and the lower end 3*b* of a new link is inserted into tube 4. The tube 1 is now placed over the upstanding end 3*a*.

Figure 2:
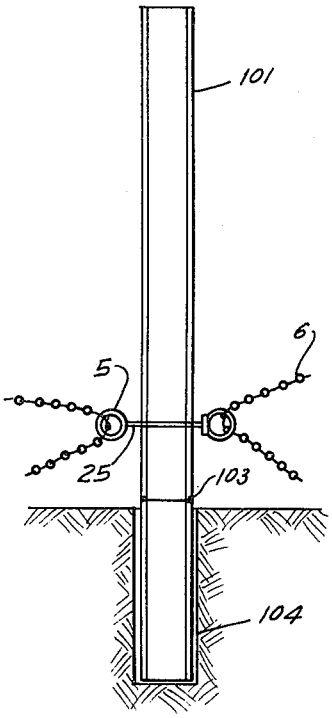
FIG. 2 is a cross sectional view through another embodiment of the invention.

While FIG. 1 illustrates the best-mode embodiment of the invention, a similar principle is used in the system of FIG. 2 in which the upper tube 101 is introduced into a socket 104 but is weakened by a scoring mark 103 at the ground level.

The synthetic resin filling may be provided as described in connection with FIG. 1 or omitted and, upon shearing of the tube 101, the upper tube section above the scoring line 103 may be repositioned with the aid of link 3 as has been shown in FIG. 1.

Figure 3:
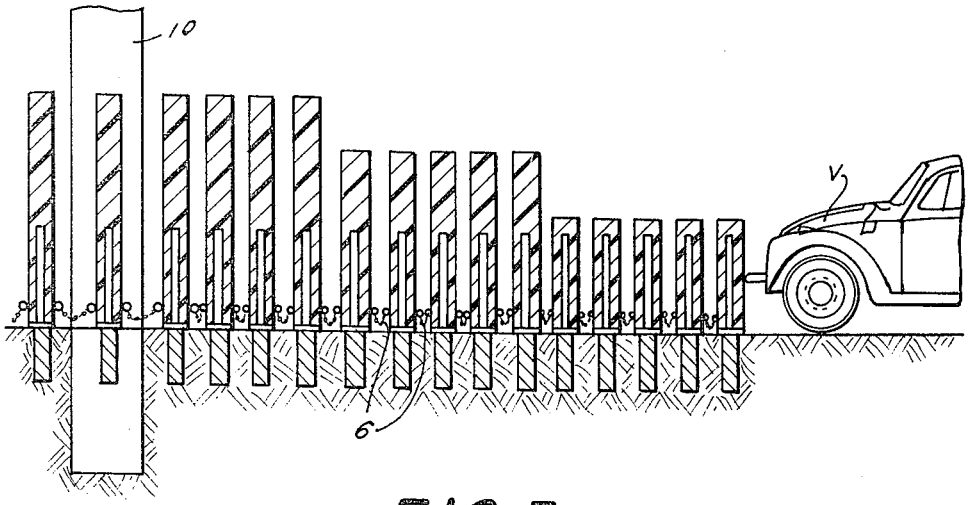
FIG. 3 is a cross sectional view through a barrier according to the invention showing the orientation of a number of posts.
Figure 4:
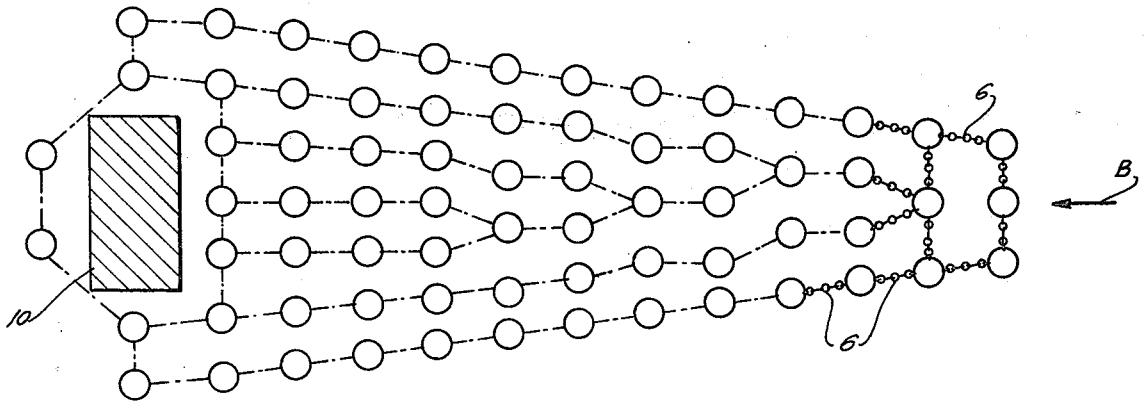
FIG. 4 is top view of the array of posts forming the barrier of FIG. 3.

From FIGS. 3 and 4 it will be apparent that the upright bodies are interconnected longitudinally and transversely by the chains 6, and that increasing numbers of bodies may be provided in the direction of vehicle travel B from row to row in the direction of the barrier. Furthermore the array of upright bodies diverges toward the obstruction which is here represented at 10.

The upright bodies may be of increasing height from the upstream end toward the obstruction (see FIG. 3) in which the upright bodies have the construction of FIG. 1 but are shown diagrammatically.

I claim

1. A safety barrier adapted to lie in the path of a vehicle directed toward a hazard and formed by an elongated array of spaced apart upright bodies extending toward said hazard, each of said bodies being provided with means enabling the shearing of an upper portion of a body from a lower portion thereof substantially at ground level, each of said bodies comprising:

a first tube received in the ground and defining said lower portion of said body;

an elongated rigid shearable link having upper and lower ends separated by a collar, said lower end having a larger diameter than said upper end and being removably received in said first tube with said collar lying substantially at ground level and facilitating the rupture of said link thereat;

a second tube positioned above said first tube and defining said upper portion of said body, said second tube being filled with a synthetic resin mass of foam formed with a space for removably receiving said upper end of said link in a spaced apart relationship with the wall of said second tube; and a network of chains of fixed length interconnecting said upper portions of said bodies, said chains being attached to said upper portions adjacent the lower ends thereof.

2. The safety barrier defined in claim 1 wherein said wall of said second tube is composed of steel sheet having a thickness of 0.5 to 2 mm.

3. The safety barrier defined in claim 2 wherein said steel sheet is hot-dipped galvanized steel sheet.

4. The safety barrier defined in claim 3 wherein said synthetic resin foam has a density of less than 150 $kp/m^3$.

5. The safety barrier defined in claim 4 wherein the number of upright bodies in said array is greater closer to said hazard.

6. The safety barrier defined in claim 5 wherein each of said upper portions is provided with a respective eyebolt, said chains traversing the eyes of said bolts.

7. The safety barrier defined in claim 6 wherein the diameter of said second tube is greater than the diameter of said first tube.

* * * * *

UNITED STATES PATENT AND TRADEMARK OFFICE

CERTIFICATE OF CORRECTION

PATENT NO. : 4,290,585

DATED : 22 September 1981

INVENTOR(S) : Ernest Glaesener

It is certified that error appears in the above-identified patent and that said Letters Patent are hereby corrected as shown below:

Column 2, line 64, change "expensive" to -- inexpensive --.

Signed and Sealed this

*Twenty-second* Day of *December 1981*

[SEAL]

*Attest:*

GERALD J. MOSSINGHOFF

*Attesting Officer* *Commissioner of Patents and Trademarks*